US005678345A

United States Patent [19]

Gnade

[11] Patent Number: 5,678,345

[45] Date of Patent: Oct. 21, 1997

[54] BARREL STABILIZATION AND RECOIL CONTROLLING APPARATUS FOR RIFLE OR SHOTGUN

[76] Inventor: Jerry Michael Gnade, 23210 Carlow Rd., Torrance, Calif. 90505

[21] Appl. No.: 574,328

[22] Filed: Dec. 18, 1995

[51] Int. Cl.[6] ..... F41C 27/22

[52] U.S. Cl. ..... 42/97

[58] Field of Search ..... 42/94, 96, 97; 224/150, 913

[56] References Cited

U.S. PATENT DOCUMENTS

| | | | |
|---|---|---|---|
| 2,240,681 | 5/1941 | Swartz | 42/97 |
| 2,259,569 | 10/1941 | King | 42/97 |
| 3,191,330 | 6/1965 | Olson | 42/97 |
| 4,127,953 | 12/1978 | McBride | 42/97 |
| 4,156,979 | 6/1979 | Katsenes . | |
| 5,018,294 | 5/1991 | McGuffee | 42/94 |
| 5,018,652 | 5/1991 | Holtzclaw | 224/150 |
| 5,233,770 | 8/1993 | Shaw | 42/94 |
| 5,265,366 | 11/1993 | Thompson | 42/74 |
| 5,332,185 | 7/1994 | Walker, III | 248/346 |
| 5,353,681 | 10/1994 | Sugg | 89/43.01 |
| 5,375,360 | 12/1994 | Vatterott | 42/74 |

*Primary Examiner*—Michael J. Carone
*Assistant Examiner*—Christopher K. Montgomery
*Attorney, Agent, or Firm*—John D. Gugliotta; David L. Volk

[57] ABSTRACT

A barrel stabilization unit is provided for stabilizing a barrel and controlling recoil of a rifle or shotgun having a barrel guide means for providing a fulcrum attachment point adjustably along the barrel of a rifle or shotgun, and fillable ballast containment means affixed to said barrel guide means for providing a counter ballast at said fulcrum attachment point, and an attachment means affixed to said fillable ballast containment means for firmly connecting the barrel stabilization unit to a rifle or shotgun.

9 Claims, 2 Drawing Sheets

BARREL STABILIZATION AND RECOIL CONTROLLING APPARATUS FOR RIFLE OR SHOTGUN

BACKGROUND OF THE INVENTION

1. Field of the Invention

The present invention relates generally to rifles and shotguns and, more particularly, to an apparatus for attachment to the barrel of a rifle or shotgun which can both stabilize the barrel as well as control gun recoil during firing.

2. Description of the Related Art

It is well known among users of rifles and shotguns, and especially among users of larger caliber, shoulder fired weapons, of the existence and effect of "recoil" when firing such weapons. The rearward reaction on the weapon resulting from the transfer of kinetic energy by the forward propelled projectile can cause various levels of discomfort and inconvenience among the various types of weapons in use.

In the related art, many active methods of combating such recoil effects are known. In general, two approaches have developed: use of mechanical shock-dampening means; and, use of energy transfer means utilizing barrel exhaust gasses. For an example of the prior method, U.S. Pat. No. 5,353,681, issued in the name of Sugg, discloses a recoil dampening device for larger caliber weapons incorporating a dynamic braking system utilizing a constant braking force applied to the barrel of such a weapon.

Also, in U.S. Pat. No. 4,156,979, issued in the name of Katsenes, a gun recoil damper is disclosed utilizing the latter method incorporating a slidable piston powered by gases drawn through a port along the gun barrel.

In addition to the active methods of combating recoil, many passive methods have developed to lessen the impact of recoil upon the user. These have generally evolved into methods of cushioning the user, or otherwise isolating the user from the gun stock. For example, in U.S. Pat. No. 5,375,360, issued in the name of Vatterott, a cushioned shoulder pad for rifle or shotgun is disclosed which included compression springs to aid the padding member in recovering and extending any cushioning properties.

Also, in U.S. Pat. No. 5,265,366, issued in the name of Thompson, a foam recoil pad for firearms is disclosed for attachment to the butt end of the weapon and having an extended contact area for dispersing the recoil energy at a lowered intensity.

Problems associated with the active methods include cost, complexity, and modification to the weapon, as well as a significant increase in the sound level resulting from many gun barrel modifications. However, passive methods merely isolate the user from the recoil, merely increasing comfort, and do not attack other problems associated with recoil, such as barrel "jump" and its effect upon accuracy. Consequently, a need has been felt for providing an apparatus and method which can reduce the effects of recoil upon the accuracy of a fired weapon in a simple, passive, and universally applicable manner.

SUMMARY OF THE INVENTION

It is therefore an object of the present invention to provide an improved barrel stabilization and recoil control apparatus for a rifle or shotgun.

It is a further object of the present invention to provide an improved barrel stabilization and recoil control apparatus for a rifle or shotgun which can increase the accuracy and repeatability of shots fired from a rifle or shotgun.

It is a further object of the present invention to provide an improved barrel stabilization and recoil control apparatus for a rifle or shotgun which operates in a passive manner, thereby not requiring physical modification to such weapon.

It is further objects of the present invention to provide an improved barrel stabilization and recoil control apparatus for a rifle or shotgun which can be utilized with various sizes and styles of weapon, is easily adjustable and portable, and is simple and inexpensive to manufacture.

It is a feature of the present invention to provide an improved barrel stabilization and recoil control apparatus for a rifle or shotgun which relies on effecting the angular momentum and rotational inertia resulting from "recoil", and not just the linear "kick", in order to stabilize the weapon and improve accuracy and repeatability by reducing vertical motion of the weapons barrel during firing.

Briefly described according to the preferred embodiment of the present invention, a barrel stabilization unit is provided for stabilizing a barrel and controlling recoil of a rifle or shotgun having a barrel guide means for providing a fulcrum attachment point adjustably along the barrel of a rifle or shotgun, and fillable ballast containment means affixed to said barrel guide means for providing a counter ballast at said fulcrum attachment point, and an attachment means affixed to said fillable ballast containment means for firmly connecting the barrel stabilization unit to a rifle or shotgun.

According to an alternate embodiment of the present invention, the preferred embodiment is provided further including a sling stud attachment means for further affixing said fillable ballast containment means at an additional point where a weapon's sling would normally be affixed.

An advantage of the present invention is that when used with the present invention, a rifle or shotgun which can realize an increase in the accuracy and the repeatability of shots fired from a the weapon.

Another advantage of the present invention is that it operates in a operates in a passive manner, thereby not requiring physical modification to such weapon.

Yet other advantages of the present invention are that it can be utilized with various sizes and styles of weapon, is easily adjustable and portable, and is simple and inexpensive to manufacture.

Further, a primary advantage of the present invention is that the barrel stabilization and recoil control apparatus for a rifle or shotgun relies on effecting the angular momentum and rotational inertia resulting from "recoil", and not just the linear "kick", in order to stabilize the weapon and improve accuracy and repeatability by reducing vertical motion of the weapons barrel during firing.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
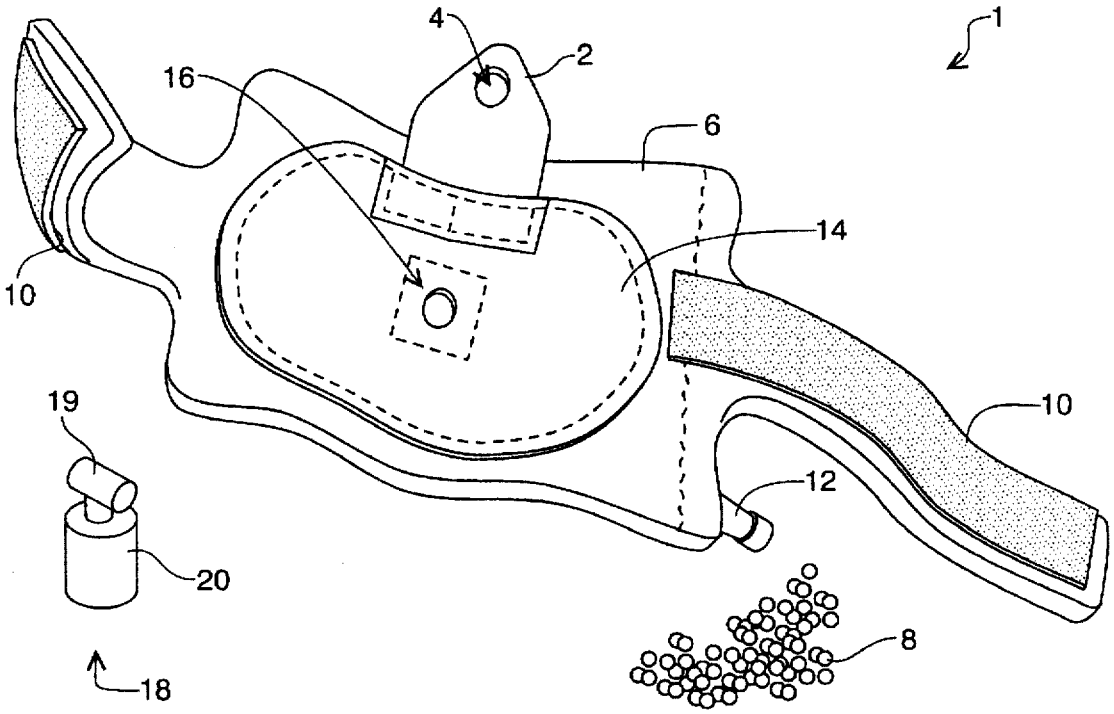
FIG. 1 is a perspective view of a barrel stabilization unit according to the preferred embodiment of the present invention, including a sling stud attachment means according to one alternate embodiment.
Figure 2:
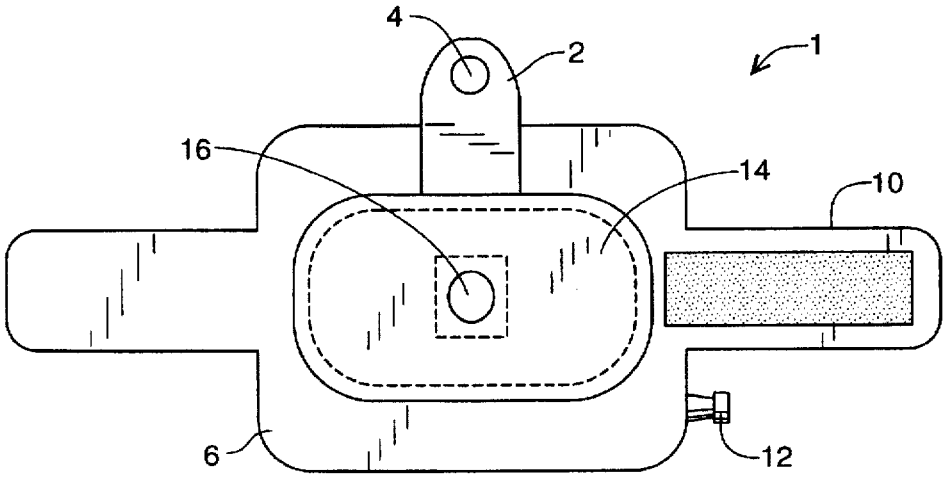
FIG. 2 is a top plan view thereof.
Figure 3:
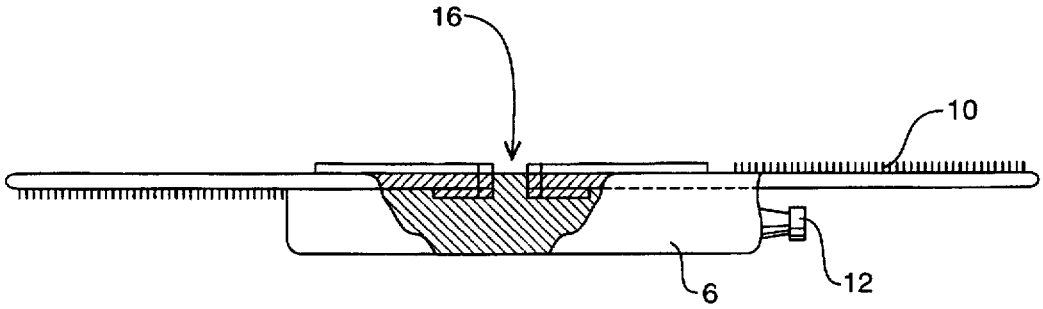
FIG. 3 is a partially cutaway front elevational view thereof.

Referring now to FIGS. 1–3, a barrel stabilization unit, generally noted as 1 is shown, according to the present invention. The barrel stabilization unit 1 is provided for stabilizing a barrel and controlling recoil of a rifle or shotgun, and has a barrel guide means 2 for providing a fulcrum attachment point 4 for attachment adjustably along the barrel of a rifle or shotgun. A fillable ballast containment means 6 for holding and containing a semi-malleable ballast 8 is affixed to said barrel guide means 2 for providing a counter ballast at said fulcrum attachment point 4. An attachment means 10 is affixed to said fillable ballast containment means 6 for firmly connecting the barrel stabilization unit to a rifle or shotgun.

Further, according to the preferred embodiment of the present invention, a variety of specific embodiments are currently envisioned incorporating the elements and teachings of the present invention. For example, it has been found that the barrel guide means 2 is effectively comprised of a rubber ear having a circular penetration as the fulcrum attachment point 4, and can e slipped over a rifle barrel and slid down to adjust to any point on the barrel down to the end of the gun stock. Also, the ballast containment means 6 can be effectively made of sewn leather, cloth, or flexible molded bag. A sealable ballast introduction means 12, herein shown as a capped filler tube, can be incorporated as access to the interior portion of the leather, cloth or flexible molded bag in order to provide a means and method of adjusting the quantity and quality of ballast 8. It has been found that maximum effectiveness of the present invention is achieved when utilized with a solid, semi-malleable ballast, such as sand or other accumulation of weighted particles. However, it has been found that the preferred ballast 8 comprises #6 to #9 lead shot, which provides greater weight in a smaller volume than sand, yet allows enough mobility to achieve fine adjustment in positioning of the weapon barrel, as will be described below.

The attachment means 10, in its preferred embodiment, is effectively comprised of a single or pair of straps lined with hook and loop fastener material such as to encircle the barrel of a rifle or shotgun and grip firmly. A frictional surface 14 can also be included along the inner surface of the barrel stabilization unit 1 in order to further aid in the gripping of the unit 1 to the barrel of a rifle or shotgun. Further provided is a sling stud attachment point 16, shown as a penetration within the center of the ballast containment means 6, which can be used in conjunction with the fulcrum attachment point 4 by providing a method and means to further mount the barrel stabilization unit 1 to a sling mounting stud, should such a sling mounting stud be provided with the rifle or shotgun.

According to an alternate embodiment of the present invention, an additional sling stud attachment means 18 is further provided in order to accommodate the sling stud attachment point 16 when in use with rifles or shotguns having a non-protruding sling attachment point. Examples of such weapons include "A" square big bore rifles, which usually include a millet flush sling stud. As shown, the sling stud attachment means 18 has a round end rounded "tee" protrusion 19 for engaging with such a millet flush sling stud, and a rounded, external stud 20 for aligning and engaging with the sling stud attachment point 16.

2. Operation of the Preferred Embodiment

Figure 4:
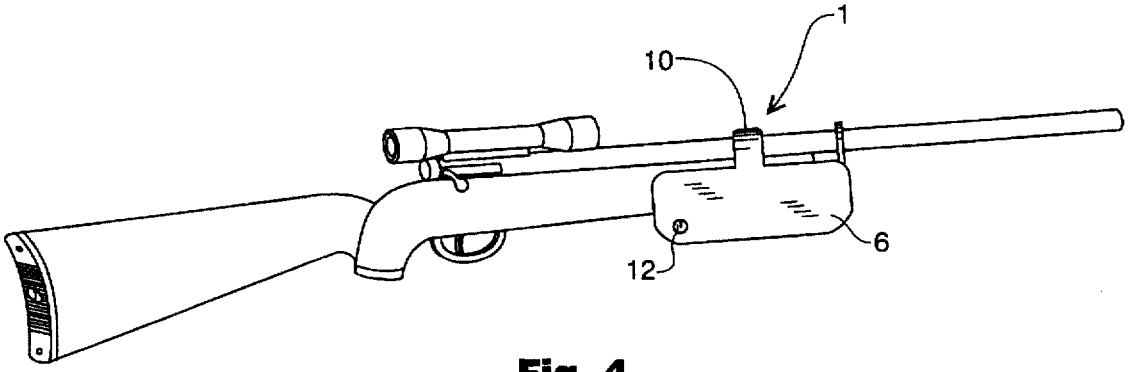
FIG. 4 is a perspective view of a the present invention being used in conjunction with a rifle or shotgun.

In operation, as shown with in FIG. 4, the present invention is utilized with a rifle or shotgun. The user first fills the ballast containment means 6 with ballast 8 such as #6–#9 lead shot, filling through the fill tube 12, until the ballast containment means 6 is flexible enough to wrap around a rifle or shotgun stock. The barrel stabilization unit 1 is then placed atop a bench rest stand or other supporting surface, having the barrel guide means 2 projecting upwards. The barrel of the rifle or shotgun is then slid into and through the fulcrum attachment point 4. The front sling stud of the rifle or shotgun is then inserted into the sling stud attachment point 16, and the attachment means 10 are wrapped around and secured to the barrel of the rifle or shotgun. The barrel stabilization unit 1 is now installed and ready, providing weight at a point along the barrel such as to significantly alter the normal angular momentum associated with the firing recoil of the rifle or shotgun. By positioning the weapon, the bench rest stand and/or sand bags close to final alignment with the target, the user can then pull the weapon inward until the user feels the weight of the barrel stabilization unit. By repeating the steps of firing, verifying alignment, and adjusting the fulcrum position of the fulcrum attachment point (or alternately, increasing or decreasing the amount of ballast 8), the user will be able to adjust the barrel stabilization unit 1 until the recoil reducing effect is maximized to the user's preference. Those user's desiring to use scope sights may also wish to make minor adjustments to the scope to insure proper sighting.

The foregoing description is included to illustrate the operation of the preferred embodiment and is not meant to limit the scope of the invention. The scope of the invention is to be limited only by the following claims.

What is claimed is:

1. An apparatus for stabilizing a barrel and controlling recoil of a firearm, the apparatus comprising:

a. a fillable ballast containment means;

b. an attachment means affixed to the ballast containment means for connecting the ballast containment means to and against the firearm;

c. a connector which is attachable to the barrel and is slidable along the barrel; and d. a flexible member extending outwardly from the ballast containment means, the flexible member including the connector distally from the ballast containment means.

2. The apparatus of claim 1, wherein the flexible member is made of rubber and the connector is a circular penetration formed in the flexible member.

3. The apparatus of claim 1, further comprising a ballast introduction means in fluid communication with the ballast containment means for introducing or exhausting ballast from the ballast containment means.

4. The apparatus of claim 3, wherein the ballast containment means comprises a hollow bag forming an inner volume and being formed of a material selected from the group consisting of cloth, leather, and molded rubber.

5. The apparatus of claim 4, further comprising a frictional surface lining one side of the ballast containment means for encountering and frictionally gripping the firearm when the attachment means is engaged with the firearm.

6. The apparatus of claim 5, wherein the frictional surface is comprised of a flat rubber material affixed to the ballast containment means.

7. The apparatus of claim 1, wherein the attachment means comprises an attachment strap extending outward from the ballast containment means, the attachment strap including hook and loop fastener material disposed thereon.

8. The apparatus of claim 1, further comprising an opening formed within the ballast containment means adapted to engage a protruding sling stud of the firearm to provide an additional attachment point between the ballast containment means and the firearm.

9. The apparatus of claim 1, further comprising:

a. an opening formed within the ballast containment means;

b. a flush stud attachment means comprising a rounded tee-shaped protrusion for engaging with a flush sling stud of the firearm, and a rounded external stud for aligning and engaging with the opening formed within the ballast containment means to provide an additional attachment point between the ballast containment means and the firearm.

* * * * *